US009540208B2

(12) United States Patent
Moore

(10) Patent No.: US 9,540,208 B2
(45) Date of Patent: Jan. 10, 2017

(54) APPARATUS AND METHODS FOR WINDING COIL USING TRAVERSE WITH ROTATING ELEMENT

(71) Applicant: REELEX Packaging Solutions, Inc., Patterson, NY (US)

(72) Inventor: Brian Moore, Newburgh, NY (US)

(73) Assignee: REELEX Packaging Solutions, Inc., Patterson, NY (US)

( * ) Notice: Subject to any disclaimer, the term of this patent is extended or adjusted under 35 U.S.C. 154(b) by 0 days.

(21) Appl. No.: 15/133,873

(22) Filed: Apr. 20, 2016

(65) Prior Publication Data

US 2016/0311640 A1 Oct. 27, 2016

Related U.S. Application Data

(60) Provisional application No. 62/152,308, filed on Apr. 24, 2015.

(51) Int. Cl.
*B65H 54/28* (2006.01)
*B65H 55/04* (2006.01)

(52) U.S. Cl.
CPC ..... *B65H 54/2893* (2013.01); *B65H 54/2806* (2013.01); *B65H 54/2818* (2013.01); *B65H 55/046* (2013.01); *B65H 2701/36* (2013.01)

(58) Field of Classification Search
CPC ..... B65H 54/2806; B65H 54/2818; B65H 54/2851; B65H 54/2893; B65H 55/046; B65H 57/006; B65H 57/28
See application file for complete search history.

(56) References Cited

U.S. PATENT DOCUMENTS

| | | | |
|---|---|---|---|
| 2,634,922 | A | 4/1953 | Taylor, Jr. |
| 3,061,238 | A | 10/1962 | Taylor, Jr. |
| 3,178,130 | A | 4/1965 | Taylor, Jr. |
| 3,375,988 | A | 4/1968 | Hude et al. |
| 3,655,140 | A | 4/1972 | Gordon et al. |
| 3,701,489 | A | 10/1972 | Goldsworthy et al. |
| 3,730,795 | A | 5/1973 | Medney et al. |
| 3,747,861 | A | 7/1973 | Wagner et al. |
| 4,085,902 | A | 4/1978 | Wagner |
| 4,238,084 | A | 12/1980 | Kataoka |
| 4,353,772 | A | 10/1982 | Groeber |
| 4,406,419 | A | 9/1983 | Kotzur |
| 4,523,723 | A | 6/1985 | Kotzur |
| 4,884,764 | A | 12/1989 | Hill |
| 5,470,026 | A | 11/1995 | Kotzur |

(Continued)

OTHER PUBLICATIONS

U.S. Appl. No. 13/887,502, filed May 6, 2013, Timothy M. Copp et al.

(Continued)

*Primary Examiner* — William E Dondero
(74) *Attorney, Agent, or Firm* — Gordon & Jacobson, P.C.

(57) ABSTRACT

Systems and methods for winding wire are disclosed. A system includes a wire take-up unit having a rotating mandrel and a traverse having a wire directing device, the wire directing device arranged to cause the wire to be wound in a figure-eight configuration on the rotating mandrel to form a coil having many layers of wire. The wire directing device reciprocates along an axis parallel to the axis of rotation of the mandrel. The wire directing device also rotates along an axis perpendicular to the axis of rotation of the mandrel so that the lay-down point of the wire directing device sweeps over an arc for each throw of the traverse.

20 Claims, 9 Drawing Sheets

(56) References Cited

U.S. PATENT DOCUMENTS

| | | | |
|---|---|---|---|
| 5,678,778 | A | 10/1997 | Kotzur et al. |
| 5,803,394 | A | 9/1998 | Kotzur et al. |
| 5,810,272 | A | 9/1998 | Wallace et al. |
| 5,938,260 | A | 8/1999 | Wallace et al. |
| 5,979,812 | A | 11/1999 | Kotzur et al. |
| 6,086,012 | A | 7/2000 | Kotzur et al. |
| 6,109,554 | A | 8/2000 | Kotzur et al. |
| 6,341,741 | B1 | 1/2002 | Kotzur et al. |
| 6,491,163 | B1 | 12/2002 | Grcic et al. |
| 6,702,213 | B2 | 3/2004 | Kotzur et al. |
| 6,766,627 | B2 | 7/2004 | Kotzur et al. |
| 7,100,346 | B2 | 9/2006 | Kotzur et al. |
| D541,145 | S | 4/2007 | Copp |
| 7,249,726 | B2 | 7/2007 | Kotzur |
| 8,079,539 | B2 | 12/2011 | Huang et al. |
| 8,191,337 | B2 | 6/2012 | Moore |
| 8,794,438 | B2 | 8/2014 | Copp et al. |
| 2013/0146696 | A1 | 6/2013 | Copp et al. |
| 2013/0283735 | A1 | 10/2013 | Copp et al. |
| 2014/0069056 | A1 | 3/2014 | Swanson et al. |
| 2014/0075883 | A1 | 3/2014 | Kotzur et al. |
| 2014/0077469 | A1 | 3/2014 | Kotzur et al. |
| 2014/0208700 | A1 | 7/2014 | Gamble et al. |

OTHER PUBLICATIONS

U.S. Appl. No. 13/950,908, filed Jul. 25, 2013, Timothy M. Copp et al.

U.S. Appl. No. 13/573,362, filed Sep. 12, 2012, Timothy M. Copp et al.

U.S. Appl. No. 14/306,632, filed Jun. 17, 2014, Mark Swanson et al.

U.S. Appl. No. 14/740,571, filed Jun. 16, 2015, Frank W. Kotzur et al.

APPARATUS AND METHODS FOR WINDING COIL USING TRAVERSE WITH ROTATING ELEMENT

CROSS-REFERENCE TO RELATED APPLICATIONS

This application claims priority to U.S. Provisional Application No. 62/152,308, filed Apr. 24, 2015 the entire contents of which are incorporated herein by reference.

BACKGROUND

1. Field

This application relates to apparatus and methods for winding coils. More particularly, this application relates to apparatus and methods for winding coils of cable, wire, or filaments that can be dispensed through a payout tube. This application has particular application to the winding of coils of cable, wire, or filaments in a figure-eight pattern, although it is not limited thereto.

2. State of the Art

U.S. Pat. No. 2,634,922 to Taylor describes the winding of flexible wire, cable or filamentary material (hereinafter "wire", which is to be broadly understood in the specification, abstract and claims) around a mandrel in a figure-eight pattern such that a package of material is obtained having a plurality of layers surrounding a central core space. By rotating the mandrel and by controllably moving a traverse that guides the wire laterally relative to mandrel, the layers of the figure-eight pattern are provided with aligned holes (cumulatively a "pay-out hole") such that the inner end of the flexible material may be drawn out through the payout hole. When a package of wire is wound in this manner, the wire may be unwound through the payout hole without rotating the package, without imparting a rotation in the wire around its axis (i.e., twisting), and without kinking. This provides a major advantage to the users of the wire. Coils that are wound in this manner and dispense from the inside-out without twists, tangles, snags or overruns are known in the art as REELEX- (a trademark of Reelex Packaging Solutions, Inc.) type coils. REELEX-type coils are wound to form a generally short hollow cylinder with a radial opening formed at one location in the middle of the cylinder. A payout tube may be located in the radial opening and the end of the wire making up the coil may be fed through the payout tube for ease in dispensing the wire.

Over the past fifty-plus years, improvements have been made to the original invention described in U.S. Pat. No. 2,634,922. For example, U.S. Pat. No. 5,470,026 to Kotzur describes means for controlling the reciprocating movement of the traverse with respect to the rotation of the mandrel in order to wind the wire on the mandrel to form a radial payout hole having a substantially constant diameter. In addition, over the past fifty-plus years, an increasing number of different types of wires with different characteristics are being wound using the systems and methods described in U.S. Pat. No. 2,635,922 and the subsequent improvements. For example, the figure-eight type winding has been used for twisted-pair type cable (e.g., Category 5, Category 6 and the like), drop cable, fiber-optic cable, electrical building wire (THHN), etc. Despite the widespread applicability of the technology, challenges remain in applying the technology effectively.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

One embodiment of a system for winding a wire includes a spindle shaft with a mandrel thereon, and a traverse that directs the wire onto the rotating mandrel in a figure-eight pattern, where the traverse has at least one reciprocating, rotating element that reciprocates relative to the rotating mandrel and simultaneously rotates back and forth about an axis perpendicular to the axis of reciprocation. A tensioner (also called a "dancer" or "accumulator") may be provided to control the tension on the wire as it applied to the rotating mandrel.

In one embodiment, a reciprocating element of the traverse is driven directly or indirectly by a crank or cam-arm and is caused to rotate by one hundred eighty degrees over the length of its movement.

In one embodiment, the traverse is provided with two in-line rollers and a rotating gear that is located between but offset from the rollers. A flexible grooved belt with fixed, optionally adjustable ends is threaded between the rollers and the rotating gear to form an open loop. When an element of the traverse is reciprocated, e.g., by a carriage activated by a crank-arm, the teeth of the gear engage the grooves in the belt, thereby causing rotation of the gear both clockwise and counter-clockwise.

In one embodiment, a wire guide that reciprocates and rotates is used to lay down the wire on the spinning mandrel. The wire-output location (laydown point) of the wire guide is adapted to be substantially tangent to and to approximate the surface of the mandrel at a starting position and then to move radially away from the mandrel in order to approximate the surface of the coil as it is wound. In one embodiment, a sensor is provided to inform movement of the traverse away from the mandrel. In another embodiment, movement of the traverse away from the mandrel is controlled based on the diameter of the wire and the number of reciprocations of the traverse.

In one embodiment, the mandrel is barrel-shaped and end-forms are located at ends of the mandrel. In one embodiment, the end-forms have flat inner surfaces, e.g., they are disk-shaped.

In one aspect, by rotating as well as reciprocating the reciprocating element of the traverse, the stroke of the cam-arm can be reduced, thereby permitting a faster winding.

DETAILED DESCRIPTION

Figure 1:
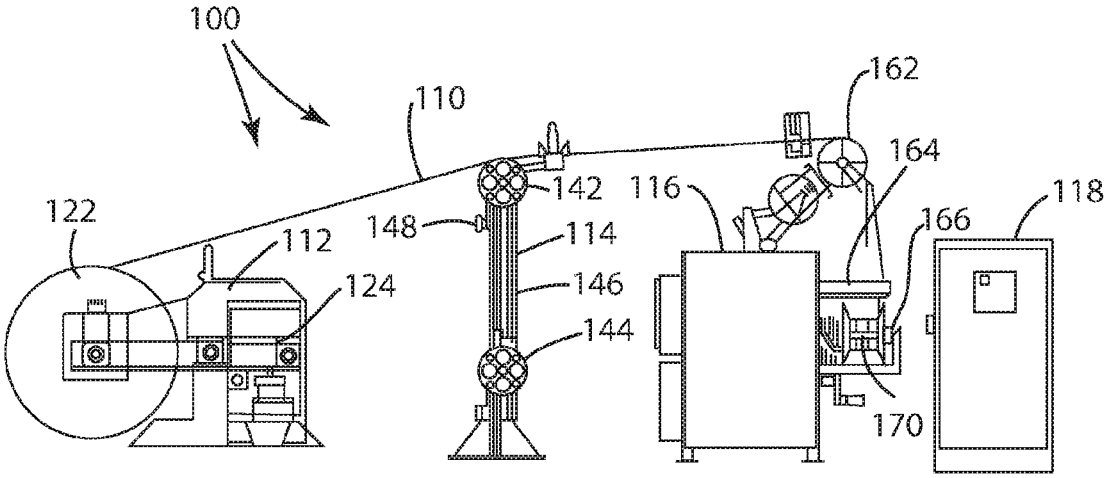
FIG. 1 is a schematic of an embodiment of a REELEX-type winding system.

One embodiment of a winding system 100 for winding wire 110 is seen in FIG. 1. System 100 is a REELEX-type winding system and is shown with a payoff or payout unit 112, a dancer/accumulator (tensioner) 114, a take-up unit 116, and a controller 118. The payoff unit 112 is shown as including a large source reel 122 of wire 110 and a motor 124 that is used to control the speed at which the wire 110 is dispensed off of the reel 122. The dancer/accumulator or tensioner 114, is shown with upper sheaves 142 and lower sheaves 144 around which the wire 110 wraps, a pneumatic cylinder 146 that applies pressure to the lower sheaves 144 of the tensioner 114 to effect a desired tension, and a distance or height sensor 148 (e.g., a laser or potentiometer system) that senses the location of the lower sheave 144 relative to the upper sheave 142. The height sensor 148 is coupled to the payoff unit 112 and can provide feedback information to the payoff unit 112, thereby informing the payoff unit to increase its speed if the amount of wire in the accumulator is low, and informing the payoff unit to decrease its speed if the amount of wire in the accumulator is high. In another embodiment, the feedback information may be provided to the take-up unit 116 and used to decrease or increase the speed thereof. The take-up unit 116 is shown to include a buffer 162, a traverse 164, a motorized spindle 166, and a mandrel 170. The traverse has a carriage that moves back and forth (reciprocates) above the surface of the mandrel 170 as the mandrel is spinning on the spindle 166, thereby causing wire 110 to be directed onto the mandrel 170. As will be described in more detail hereinafter, as the carriage of the traverse reciprocates, an element of the traverse that directs the wire onto the mandrel also rotates back and forth about an axis perpendicular to the reciprocation. The function of the entire system 100 is to cause wire 110 to be wound in a figure-eight pattern in a manner forming a payout hole extending radially out from the mandrel 170. The controller 118 is coupled to the take-up system 116 and can provide speed control information to direct the take-up system 116 to run at a desired rate. For example, the controller 118 may direct the take-up system 116 to cause the spindle 166 to run at a constant speed, or may cause the take-up system 116 to have the line speed be constant, thereby requiring the spindle speed to slow down over a period of time.

Figure 3:
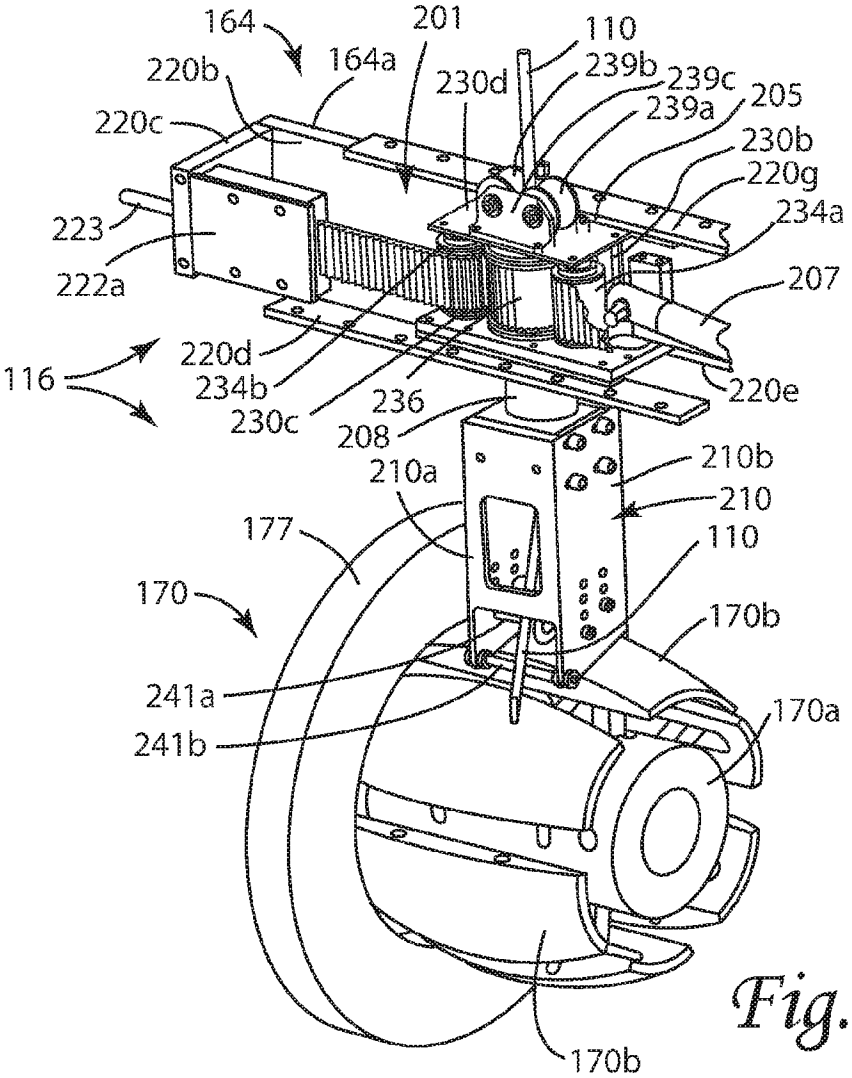
FIG. 3 is a partial perspective view of the traverse and mandrel of FIG. 1 with parts removed for visualization.
Figure 2:
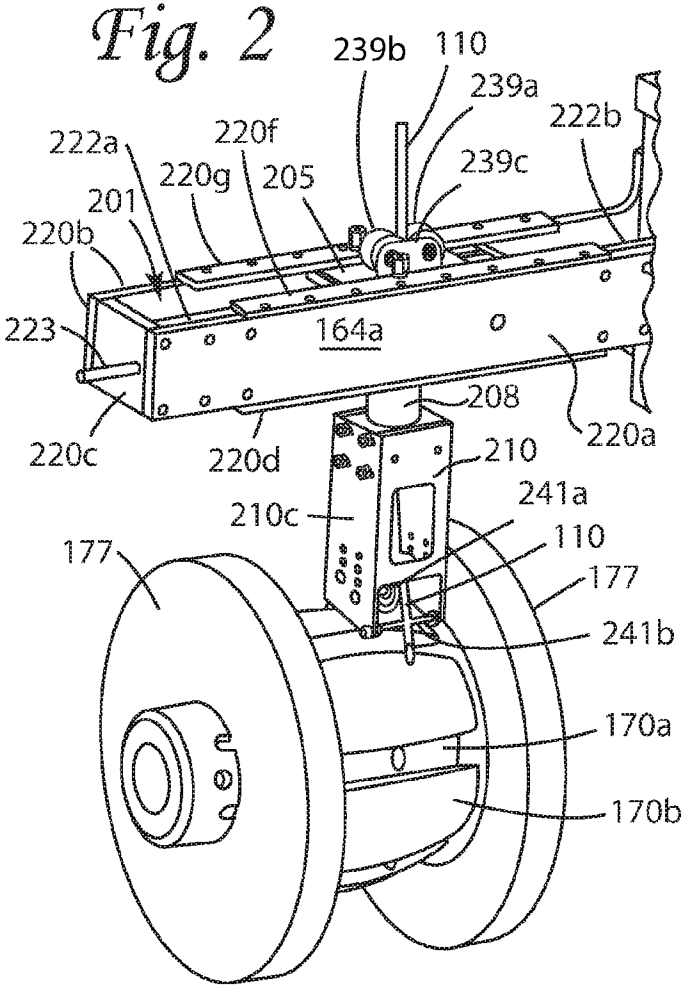
FIG. 2 is a perspective view of the traverse and mandrel of FIG. 1.

Turning now to FIGS. 2 and 3, perspective views of the traverse 164 and mandrel 170 of the take-up unit 116 of system 100 are seen in more detail. Mandrel 170 is comprised of a central hollow cylindrical element 170*a* that extends around and is coupled to the spindle 166, and a plurality of segments 170*b* radially attached to the central element 170*a*. Each segment 170*b* of the mandrel is shown with an outer surface that is bowed out (convex) in two directions. Each segment is coupled to the central element 170*a* via at least one arm or rod (not shown) which are arranged to rotate so that the segments 170*b* can move from a first collapsed position (not shown) where the segments are closer to the central element 170*a* and to each other, to a second expanded or extended position shown in FIG. 2 where the segments 170*b* are further away from the central element 170*a* and are spaced further from each other. In the first collapsed position, the segments may touch each other or be very closely adjacent to each other. In the first collapsed position, the segments take the shape of a bumpy barrel. In the second expanded or extended position seen in FIGS. 2 and 3, the segments are spaced from one another and their outer surfaces appear at any cross-section to define a circle, although again, the circle may be slightly bumpy. A lock may be provided to keep the segments in the expanded position and/or in the collapsed position.

As seen in FIG. 2, end-forms 177 may be provided that "sandwich" the mandrel segments 170*b* and extend radially from the central element 170*a*. In the embodiment of FIG. 2, the end-forms 177 are shaped substantially as disks. At least one of the end-forms 177 (e.g., the outer end-form) may be removed from the mandrel so that a coil of wire may be removed from the mandrel after a winding is completed. In one embodiment, an end-form arm (not shown) is provided and may be activated to cause automated removal of the outer end-form 177 when the mandrel is not spinning.

The traverse 164 is formed as a cantilevered hollow beam 164*a* having a longitudinal slot 201 through which a carriage 205 extends. The carriage 205 is driven by a motorized cam arm 207 of the take-up unit 116 (FIG. 1) which is coupled thereto and which causes the carriage 205 to reciprocate back and forth in the beam 164*a*. The carriage 205 is coupled by a rotating tube 208 to a wire guide 210 which has one end located close to the mandrel 170. Wire 110 that is to be wound on the mandrel is threaded through the carriage 205 and the tube 208 and is guided by the wire guide 210 so that it is laid down on the mandrel 170 at a desired location. As is described in more detail hereinafter, the carriage travels in (i.e., reciprocates in) the longitudinal slot 201 of the beam 164*a* at desired speeds and along desired distances as controlled by the take-up system 116 as optionally informed by the controller 118 in order to form the figure-eight pattern in a manner forming a payout hole. As described in more detail hereinafter, as the carriage reciprocates, the tube 208 reciprocates with the carriage and is caused to rotate back and forth, thereby causing the wire guide 210 to reciprocate and rotate as well.

In winding a figure-eight coil of wire, an end of the wire 110 is captured by the mandrel 170, and the mandrel is spun by the spindle 166 as the traverse 164 reciprocates and guides the wire onto the mandrel in a figure-eight pattern with a payout hole. By way of example only, in a winding machine, if the traverse makes one complete cycle for each two revolutions of the mandrel, a figure-eight will be wound on the surface of the mandrel. With each two revolutions of the mandrel, the figure-eights will be wound, essentially in the same location. This location may be called "location zero". If a speed bias (plus or minus) is set into the traverse, the figure-eights will lie at different locations other than location zero. For instance, if the traverse is set with a 5% (plus) speed bias, the traverse will have completed its cycle before the mandrel has reached its starting point. When the mandrel has made its two revolutions (720 degrees), the traverse, by virtue of its+5% bias will be into its new cycle by thirty-six degrees (0.05×720). As a result, the next figure-eight will be thirty-six degrees ahead (i.e., in the same direction as the rotation of the mandrel) of the previous figure-eight. If the speed bias of the traverse is set to a −5%, the second figure-eight will lie behind (i.e., in the direction opposite the rotation of the mandrel direction) the first one. If the traverse speed bias is set to +5% and allowed to continue, eventually, after twenty spindle revolutions, the tenth figure-eight will have advanced 360 degrees and will lie on top of the first wound figure-eight. If, instead of allowing this to continue, the traverse speed bias is changed to −5% after sixteen mandrel revolutions, the ninth and tenth figure-eight for that layer will not be present. There will be a void on the surface of the mandrel for this first layer that is seventy-two degrees of the mandrel surface. Continuing with the −5% traverse speed bias, with each two mandrel revolutions, the figure-eights will lie behind the previous one wound by thirty-six degrees. Eventually, the figure-eights will have returned to the zero position, thereby completing a super-cycle. By repeating this process between plus and minus, a coil will be produced that has a radial hole that is seventy-two degrees of its circumference.

Turning now to FIGS. 2, 3 and 4*a*-4*c*, details of the traverse 164 are seen in more detail. In particular, hollow beam 164*a* is shown with side walls 220*a*, 220*b*, end wall 220*c* affixed to the side walls 220*a*, 220*b*, bottom rails 220*d*, 220*e* respectively affixed to side walls 220*a*, 220*b*, and top rails 220*f*, 220*g* respectively affixed to side walls 220*a*, 220*b*. Belt terminating blocks 222*a*, 222*b* are attached, e.g., by rivets, bolts or screws, to side wall 220*a*. The belt terminating blocks 222*a*, 222*b*, hold a flexible toothed belt 225 in place inside slot 201 of beam 164*a*. Tensioners 223 (one shown) may be attached to the blocks in order control tension on the belt. The ends of the belt 225 may be attached by rivets, bolts, or screws to the tensioners of the terminating blocks 222*a*, 222*b*. The carriage 205 is provided with two side plates 230*a*, 230*b*, a bottom plate 230*c*, and a top plate 230*d*. The bottom plate 230*c* and the top plate 230*d* support axles 233*a*, 233*b*, 233*c* of rollers 234*a*, 234*b*, and toothed roller or gear 236 which are all free to rotate about their respective axles which are perpendicular to the horizontal axis of the hollow beam 164*a*. The flexible toothed belt 225 is threaded between the support rollers 234*a*, 234*b* and the gear 236 with teeth 236*a* of gear 236 engaging aligned grooves 225*a* of the belt 225. As seen best in FIGS. 4*a*-4*c*, support rollers 234*a* and 234*b* are axially aligned, and the center of gear 236 is offset from the support rollers so that the belt 225 assumes an open-loop configuration with the ends of the belt extending parallel to the horizontal axis of the hollow beam 164*a*. Bearings (not shown) may be provided between the side plates 230*a*, 230*b* of the carriage and the side walls 220*a*, 220*b* of the hollow beam 164*a*, between the bottom plate 230*c* of the carriage and the bottom rails 220*d*, 220*e* of the hollow beam 164*a*, and between the top plate 230*d* of the carriage and the top rails 220*f*, 220*g* of the hollow beam, so that as the cam arm 206 moves back and forth, the carriage 205 may reciprocate easily inside the slot 201. As seen best in FIGS. 4*a*-4*c*, as the carriage reciprocates back and forth horizontally, the gear 236 rides along the toothed belt 225 and is caused to rotate clockwise and counterclockwise about its axis X. Thus, gear 236 is an element of the traverse that both reciprocates and rotates. By appropriately sizing the gear 236 and the spacing of the belt teeth 225*a* relative to the throw of cam arm 207, the gear 236 can be controlled to rotate a desired amount. Thus, in one embodiment, from a middle position, gear 236 is caused to rotate ninety degrees in one direction and ninety degrees in another direction. In other words, in one embodiment the entire stroke of cam arm 207 causes a total rotation of 180 degrees in gear 236. In another embodiment, gear 236 is caused to rotate a total rotation of less than 180 degrees. In another embodiment, gear 236 is caused to rotate a total rotation of more than 180 degrees.

Figure 4A:
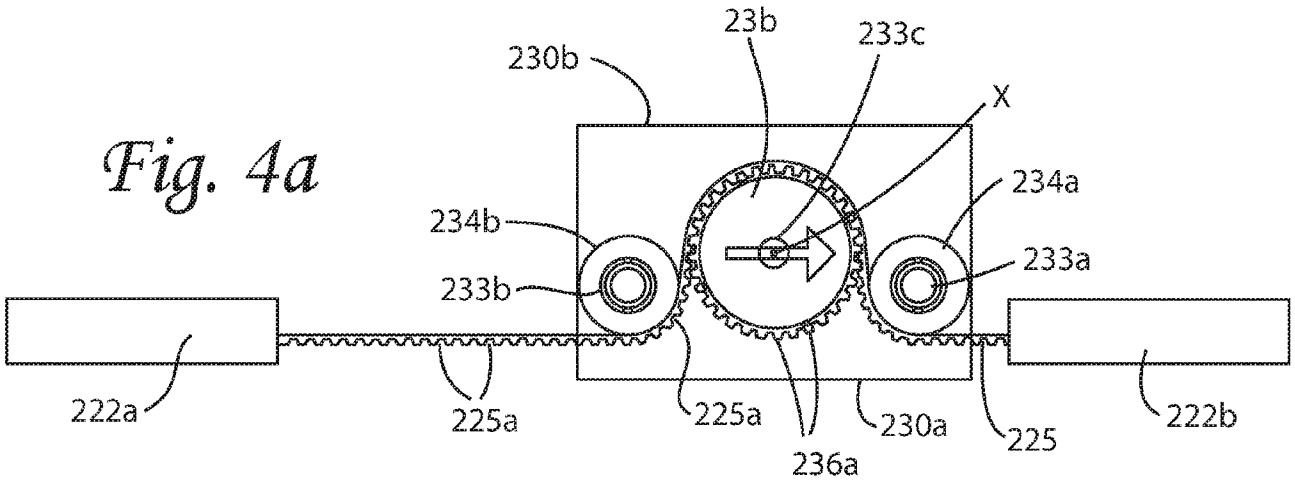
FIGS. 4*a*-4*c* are schematics of a rotation system for the reciprocating element of the traverse showing a carriage of the traverse in a first end position with a rotation gear in a first position, a second middle position with the rotation gear rotated into a second position, and a third end position with the rotation gear rotated into a third position.
Figure 4B:
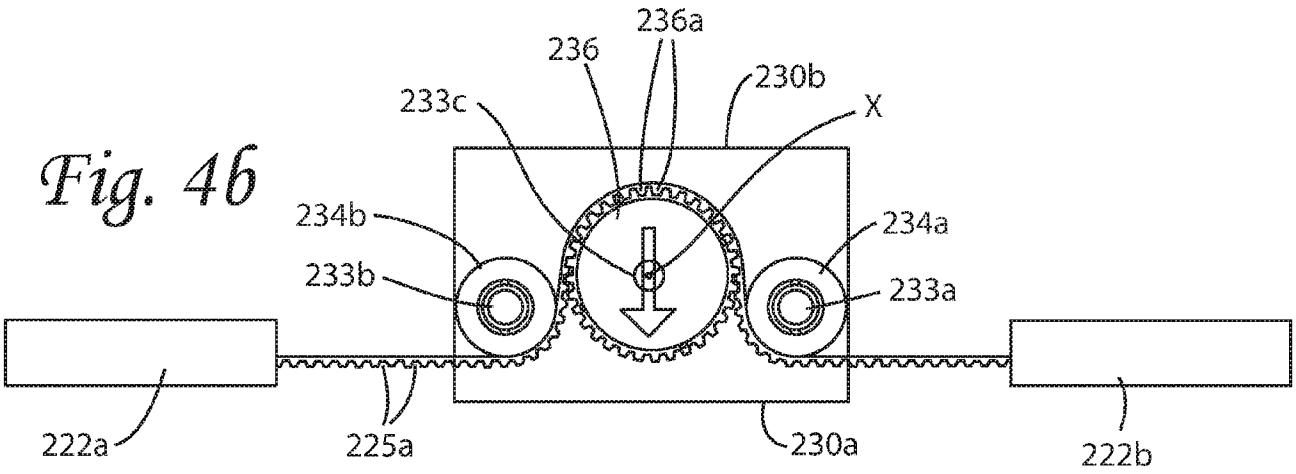
Figure 4C:
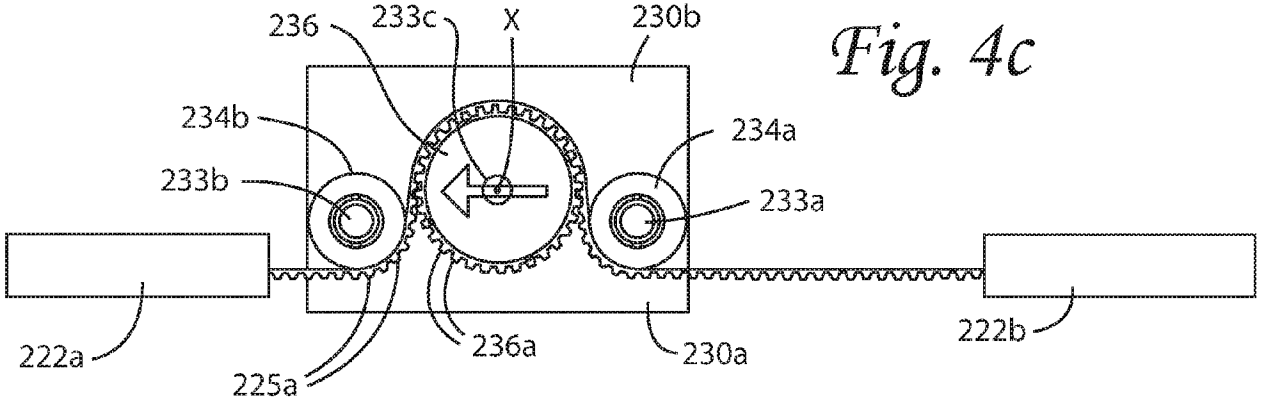

Tube 208 extends into the gear 236 and is affixed thereto. Thus, when carriage 205 reciprocates and gear 236 rotates, tube 208 similarly reciprocates and rotates. The tube 208 extends from the gear 236, through the bottom plate 230*c* of the carriage 205 and is coupled to a wire guide 210 which is shown as having the wire exiting therefrom at the bottom of a front face 210*a* of the guide. Thus, as tube reciprocates and rotates, wire guide 210 similarly reciprocates and rotates. As a result, as guide 210 moves laterally from a center position shown in FIG. 2 (where gear 236 is as shown in FIG. 4*b*) to a first end position (where gear 236 is as shown in FIG. 4*c* in a second position rotated by ninety degrees as indicated by the arrow) where it is adjacent an end-form 177, the guide 210 rotates, e.g., 90 degrees, so that the wire 110 exiting the wire guide 210 at the bottom of the front face thereof is laid down adjacent the end form 177. Then, as the guide 210 moves from the first end position through the center position to a second end position (where gear 236 is as shown in FIG. 4*a* in a third position rotated again as shown by the arrow), the guide rotates, e.g., 180 degrees, so that the wire 110 exiting the wire guide at the bottom of the front face thereof is laid down adjacent the other end form. Effectively, the front of the wire guide traverses an arc (e.g., a half oval) as it rotates and translates simultaneously. As will be described hereinafter, in one embodiment, the traverse 164 also moves laterally away from the mandrel 170.

It is seen that the path of the wire 110 is from the source reel 122 (FIG. 1), via the tensioner 114 and buffer 162 to the carriage 205 of the traverse 116, and then through the hollow tube 208 to the wire guide 210. As seen in FIGS. 2 and 3, the carriage 205 may be provided with feed wheels 239*a*, 239*b* which are supported by one or more flanges 239*c* attached to the top plate 230*d* of the carriage. The wheels rotate about axles that are perpendicular to both the longitudinal axis of the beam 164*a* and the (vertical) axis of the wire feed. As the carriage 205 reciprocates horizontally, the wheels 239*a*, 239*b* keep the wire 110 centered and fed vertically down through the carriage 205 and through the hollow tube 208 to the wire guide 210.

In one embodiment, the wire guide 210 is a hollow rectangular box attached to hollow tube 208 (e.g., by bolts or screws) which extends upward therefrom to the carriage 205. As seen in FIGS. 2 and 3, the wire guide 210 may have a front face 210*a*, side faces 210*b*, 210*c* and a rear face 210*d*. The side faces 210*b*, 210*c* may be used to support one or more rollers 241*a*, 241*b* which direct the wire 110 so that it exits the guide 210 (at a terminal location) substantially tangent to the mandrel segments 170*b*, thereby reducing stress on the wire. More particularly, the rollers 241*a*, 241*b* may be used to gently curve the wire 110 a desired amount depending upon the relative location of the front face 210*a* of the guide 210 relative to the mandrel 170.

In another embodiment a wire guide is provided with a lubricious tube through which the wire 110 extends. The tube may extend from the bottom of the front face of the wire guide to the bottom of the tube 208, or to a location in the tube 208, or to the carriage 205, or to above the carriage. If the tube extends from a terminal at the bottom of the front face of the wire guide to above the carriage, in one embodiment, rollers 239*a*, 239*b* above the carriage may be eliminated, and there likewise may be no need for rollers 241*a*, 241*b* in the guide 210.

According to one aspect, the wire guide 210 is arranged so that the wire 110 exits the guide at a location that approximates (i.e., is directly adjacent) the surface of the mandrel 170 or the surface of the wound wire on the mandrel 170. In another aspect, the wire guide 210 is arranged so that at least a portion of the wire guide 210 is directly adjacent the surface of the mandrel 170 or the surface of the wound wire on the mandrel 170. In one embodiment, "approximating" or being "directly adjacent" a surface means being within 1 cm (0.4 inch) of the respective surface at at least one location along the throw of the wire guide. In another embodiment, "approximating" or being "directly adjacent" a surface means being within 2.5 cm (1 inch) of the respective surface at at least one location along the throw of the wire guide. In another embodiment, "approximating" or being "directly adjacent" a surface means being within 5.0 cm (about 2 inches) of the respective surface at at least one location along the throw of the wire guide. Where the mandrel is cylindrical, the wire may exit the guide at a location within a particular distance of the surface of the mandrel (e.g., within 1 cm) along the entire throw of the wire guide. Where the mandrel is barrel shaped, the distance from location of the exit of the guide to the surface of the mandrel will typically vary along the throw of the wire guide. Because the wire guide 210 causes the wire to exit directly adjacent the surface, in one embodiment, the bottom of the wire guide is located between the end-forms 177 of the mandrel during most or all of the winding procedure. More particularly, if the outer circular edges of the end-forms 177 define an imaginary cylinder, the bottom of the wire guide will be located within the wall boundary of that imaginary cylinder during the majority (e.g., more than 50%), the vast majority (e.g., more than 90%) or the entire of the winding procedure.

According to one aspect, the wire guide 210 is arranged so that when the wire guide is at an end position and is rotated relative to a middle position, the wire 110 exits the guide directly adjacent the end-form 177. In one embodiment, the positioning of the wire 110 is so exact such that at an end position, the wire 110 may be within 0.5 cm (0.2 inches) of the end-form 177 as it laid down. In another embodiment, the positioning of the wire 110 is so exact such that at an end position, the wire 110 may touch the end-form 177 as it is laid down.

Figure 5:
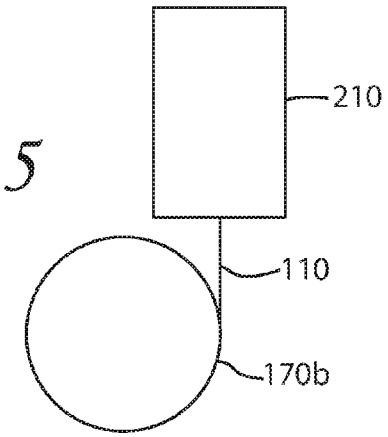
FIG. 5 is a schematic showing wire exiting a wire guide tangent a mandrel.

According to one aspect, and as seen in FIG. 5, the wire guide 210 is arranged so that when the wire 110 exits the guide, the wire is substantially tangent to the mandrel segments 170*b*. In one embodiment, "substantially tangent" means within ten degrees (10°) of a tangent.

According to one aspect, by providing a traverse with a reciprocating, rotating wire guide, the throw of the carriage and wire guide can be shorter than what would be required if the wire guide did not rotate, and the speed of the point where the wire is placed down will exceed the speed of the lateral movement of the guide tube. As a result, in one embodiment, the speed of the mandrel rotation and the laying down of the wire may be substantially increased relative to prior art figure-eight winding systems.

According to one aspect, in order for the bottom of the wire guide 210 to approximate the surface of the mandrel 170 and then the surface of the wound wire as it is being wound around the mandrel, the wire guide is adapted to move radially away from the mandrel in order to approximate the surface of the coil as it is wound. In one embodiment, a sensor (not shown) is provided to inform movement of the traverse away from the mandrel. In another embodiment, movement of the traverse away from the mandrel is controlled by a controller, e.g., controller 118, based on the diameter of the wire (which may be entered by an operator), the size of the mandrel (which may likewise be entered by the operator) and the number of reciprocations of the traverse (which may be tracked by the controller).

Figure 6:
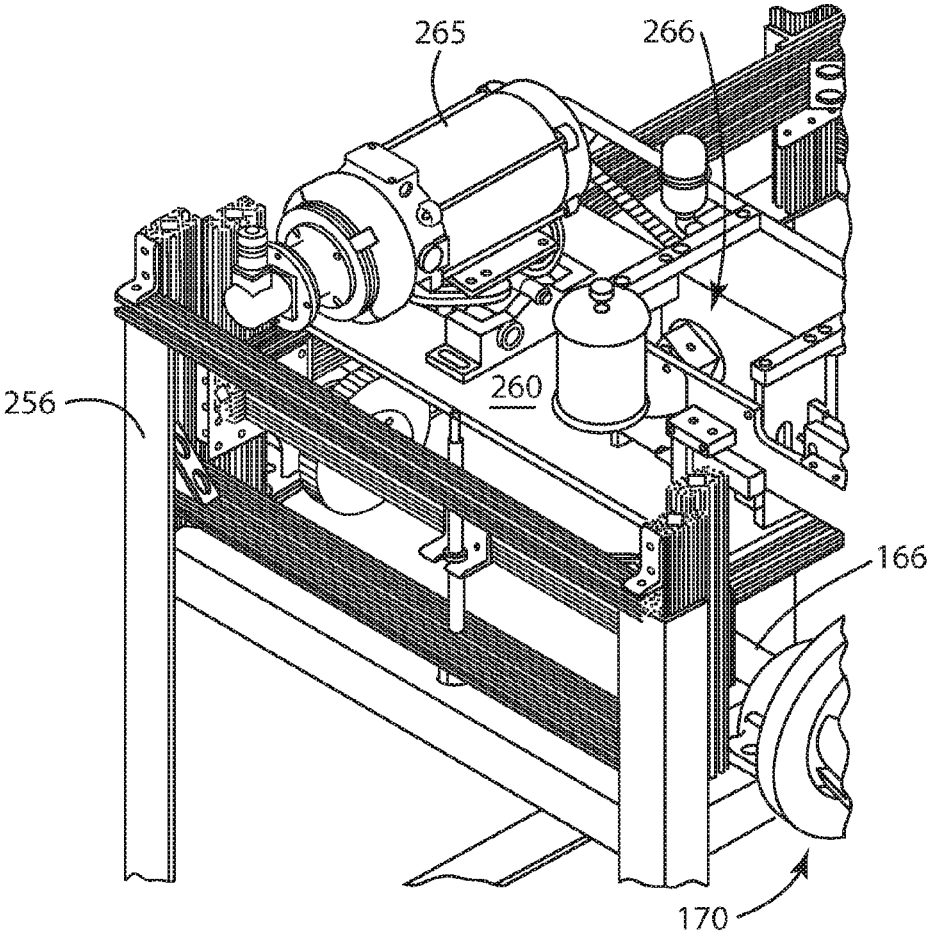
FIG. 6 is a partial schematic of the traverse of FIG. 1 showing an adjustment mechanism.

Turning to FIG. 6, in one embodiment the take-up unit 116 is provided with a frame 250 and a platform 260. The platform is used to support a motor 265, a cam 266 which drives the cam arm 207, and the cantilevered hollow beam 164*a*. The platform 260 therefore supports the traverse 164. The platform may also support other elements such as grease pots, gears, etc., with lubricator 280 for the moving parts of the traverse specifically identified. A plurality of motorized screw jacks 270 (one shown) extend from the frame 250 and are provided to support the platform 260 and move it to a desired height. In this manner, the cantilevered beam 164*a* of the traverse, and hence the wire guide 210, are automatically moved radially (e.g., vertically) away from the surface of the mandrel as wire is wound around the mandrel. As a result, the bottom of the wire guide from where the wire is laid onto the mandrel or coil can be maintained to be directly adjacent the mandrel or coil. In one embodiment, the screw jacks 270 are controlled by a sensor (not shown) such as an optical or inductive sensor which senses the distance from the bottom of the wire guide 210 to the mandrel or to the wire wound around the mandrel, or by a controller which mathematically calculates the movement of based on the amount of wire that has been wound.

Figure 7:
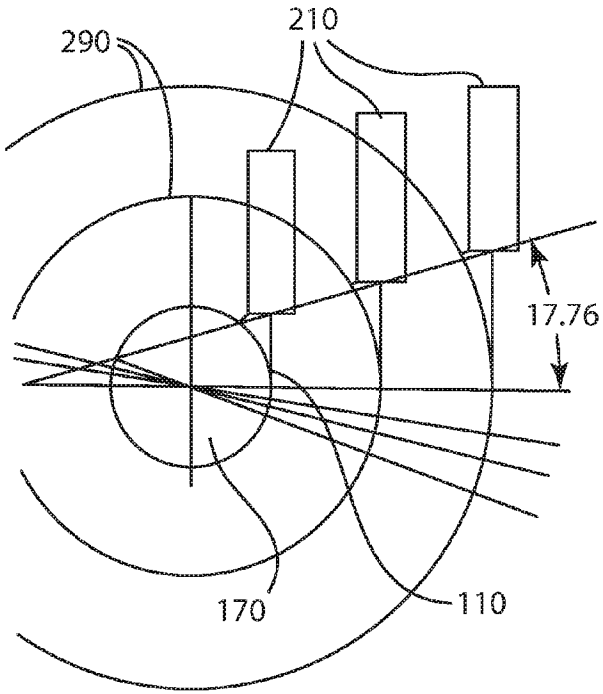
FIG. 7 is a schematic showing wire exiting a wire guide tangent a mandrel and tangent a coil with the wire guide moving in two axes.

In one embodiment, rather than using screw jacks which move along a single axis in order to move the platform 260 away from the mandrel 170, motorized support pins (not shown) that travel in two axes such as a line or a controlled arc (e.g., a curved path) are used to support the platform 260. In this manner, the platform 260, and hence the cantilevered beam 164*a*, carriage 205 and wire guide 210 are moved radially away from the mandrel 170 in two directions (e.g., vertically and horizontally). Thus, as seen in FIG. 7, wire guide 210 is directly adjacent the mandrel 170 at the beginning of the winding process with wire being substantially tangent the mandrel. As the winding process proceeds and a coil 290 of wire 110 is formed on the mandrel, the wire guide 210 is moved along two axes so that the wire guide is still directly adjacent the mandrel and the wire is laid down substantially tangent the mandrel. In FIG. 7, an intermediate position and an ending position are shown for the wire guide 210 as coil 290 is formed. For a six inch diameter mandrel and a 22 inch final diameter for the coil 290, if the wire guide follows a straight line path (based on the starting and ending positions), or an arc (based on beginning, ending, and all intermediate positions), the wire guide 210 can be moved at an angle of approximately 18 degrees relative to a horizontal so that the wire is continually laid down substantially tangent the mandrel. In one embodiment, the wire guide is moved at one or more angles between 15 and 21 degrees from a horizontal during the winding process.

Figure 8A:
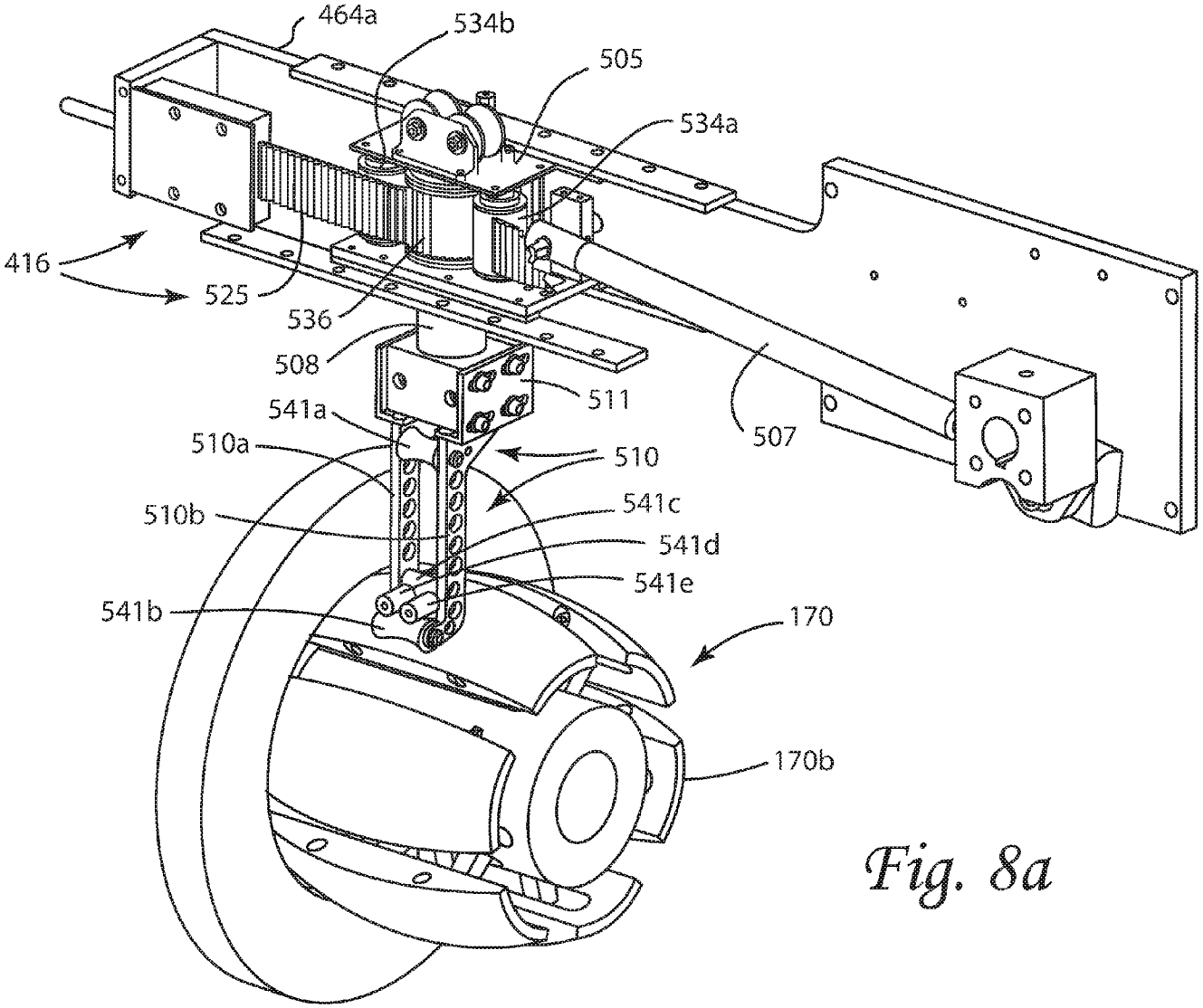
FIG. 8*a* is a perspective view of another embodiment of a traverse and mandrel with parts removed for visualization, with a carriage and wire guide of the traverse in a first position.
Figure 8B:
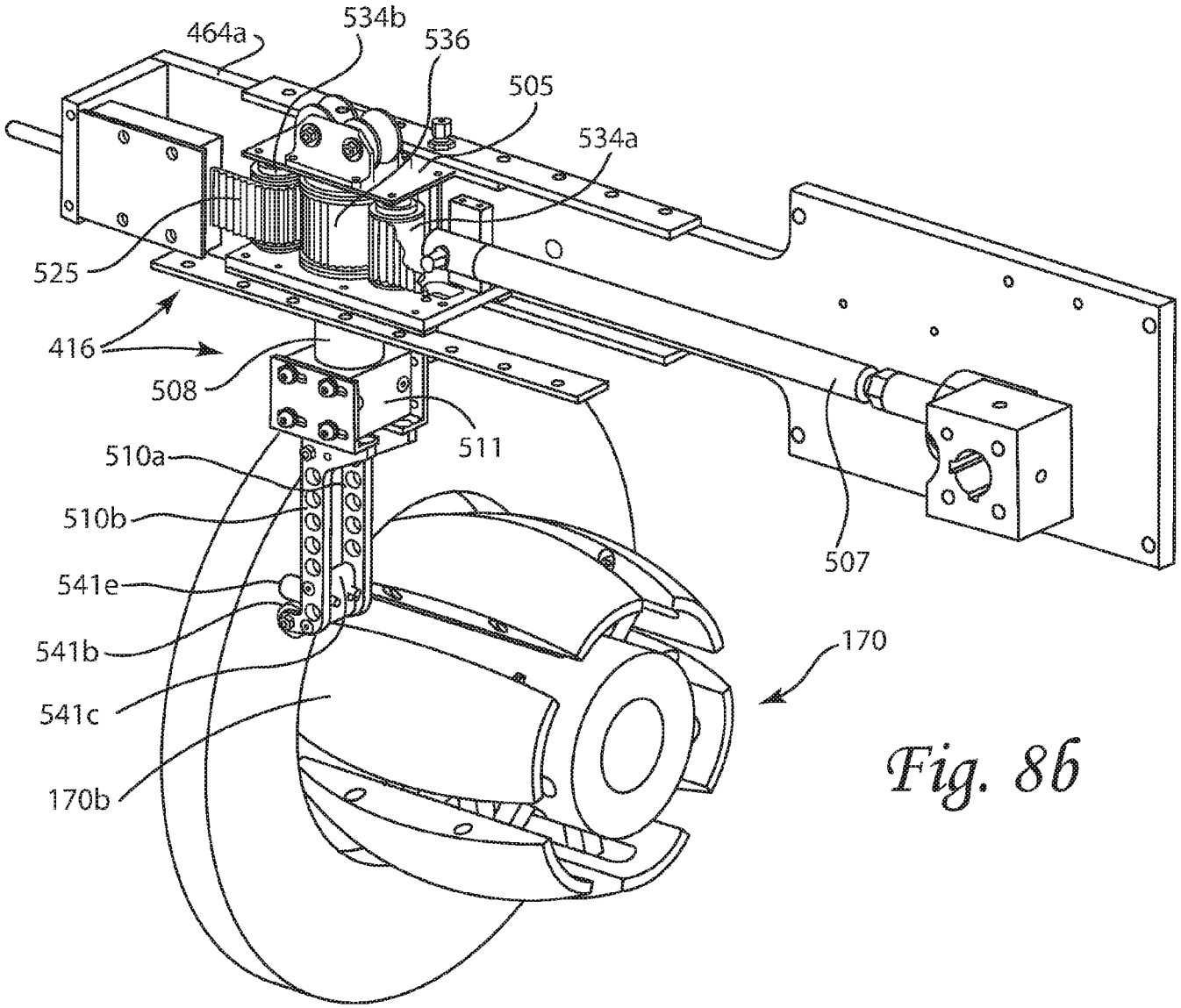
FIG. 8*b* is a perspective view of the embodiment of the traverse and mandrel of FIG. 8*a* with the carriage and wire guide in a second position.

Turning to FIGS. 8*a* and 8*b*, another embodiment of a traverse 416 is seen where the wire guide 510 has been modified relative to the wire guide 210 of FIGS. 2 and 3. In all other respects, the traverse 416 is the same as traverse 116 of FIGS. 2 and 3 such that it includes a beam 464*a*, a carriage 505 driven by a cam arm 507, a belt 525 threaded between support rollers 534*a*, 534*b* and gear 536, a rotating tube 508, etc. As seen in FIGS. 8*a* and 8*b*, wire guide 510 has a hollow rectangular box portion 511 that is attached to the hollow tube 508 (e.g., by bolts or screws) so that it moves and rotates with the tube 508 as seen by comparing FIGS. 8*a* and 8*b* which respectively show the traverse at a middle and end of a throw. The box 511 supports legs 510*a*, 510*b*, which in turn may be used to support one or more rollers or roller supports. Thus, as seen in FIGS. 8*a* and 8*b*, legs 510*a* and 510*b* support an upper roller 541*a* and a lower roller 541*b*, and a roller support 541*c* (seen best in FIG. 8*b*) which support rollers 541*d*, 541*e* which are located adjacent lower roller 541*b*. In one embodiment, the legs 510*a*, 510*b* are curved so that roller 541*b* is offset relative to roller 541*a*. The rollers direct the wire so that it exits the guide 510 substantially tangent to the mandrel segments 170*b*, thereby reducing stress on the wire. More particularly, the rollers 541*a*, 541*b*, 541*d*, 541*e* may be used to gently curve the wire a desired amount depending upon the relative location of the front face of the guide 510 relative to the mandrel 170.

Figure 9:
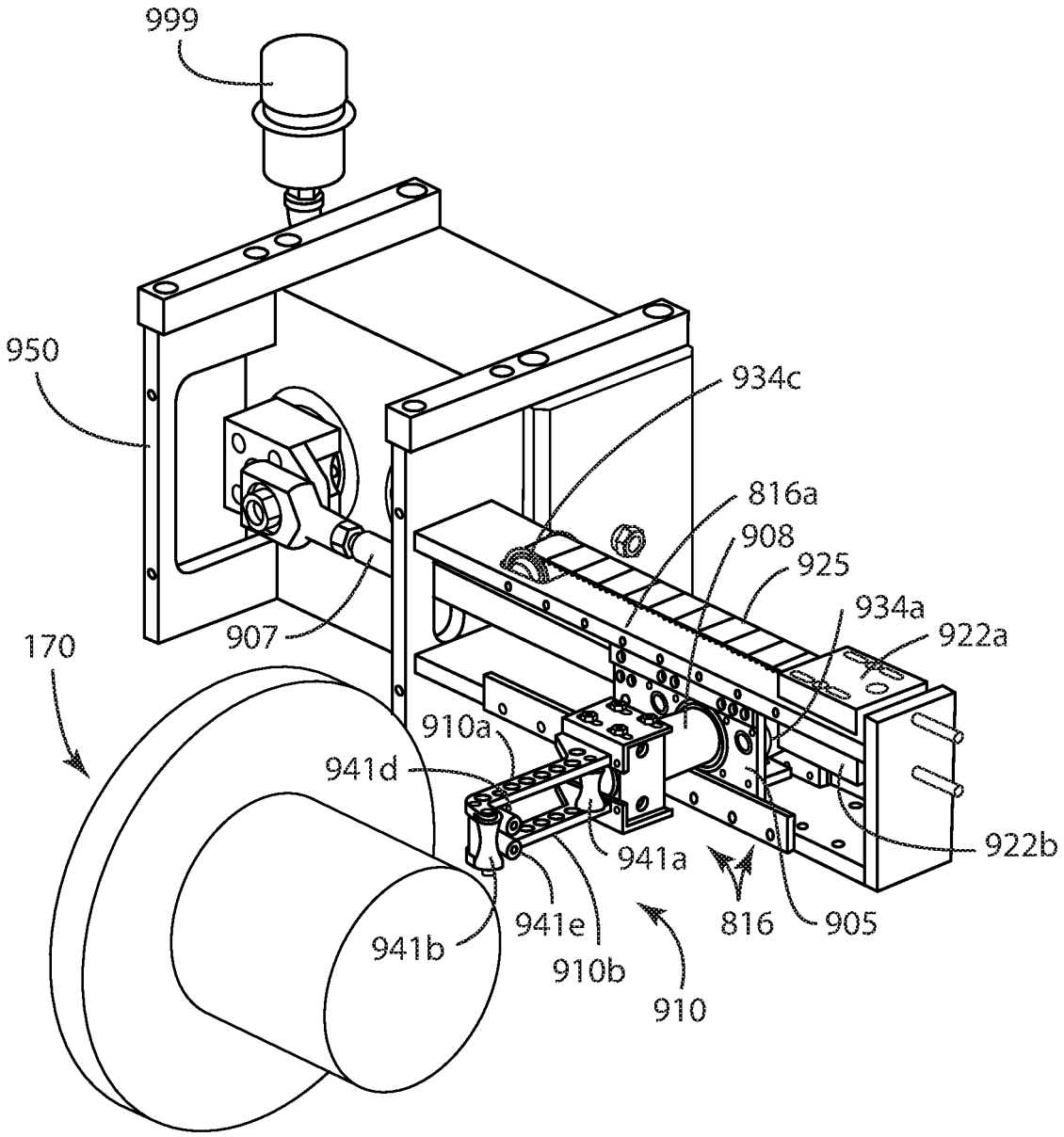
FIG. 9 is a front perspective view of another embodiment of a traverse.

Another embodiment of a traverse is seen in FIG. 9. In FIG. 9, traverse 816 is similar in many ways to the embodiments of FIGS. 2, 3, 4*a*-4*c*, and 8*a*-8*b*, except that the traverse 816 is situated lateral (to the side of) the mandrel 170 rather than above the mandrel. As a result, many of the elements of the traverse 816 such as the carriage 905, the cam arm 907, the wire guide 910 with arms 910*a*, 910*b*, and rollers 941*a*, 941*b*, 941*d*, 941*e*, the belt 925, the belt tensioners 922*a*, 922*b*, the rollers (only 934*a* shown) and gear (not shown) through which the belt 925 is threaded, the rotating tube 908, etc., are oriented at a rotation of ninety degrees relative to the embodiments of FIGS. 2, 3, 4*a*-4*c*, and 8*a*-8*b*. In the embodiment of FIG. 9, another roller 934*c* for the belt 925 is provided such that the belt travels from a first tensioner 922*a* attached to the outside of the hollow cantilever beam 816*a*, around the roller 934*c*, and then doubles back inside the beam 816*a* to second tensioner 922*b* located inside the beam 816*a*. The traverse 816 functions substantially as traverse 116 of FIGS. 2 and 3 and traverse 416 of FIGS. 8*a* and 8*b* with the wire guide 910 rotating with tube 908 and reciprocating relative to the mandrel as the carriage reciprocates in the cantilever beam 816*a*.

Also shown in FIG. 9 is a platform 950 for supporting the traverse 816 and other elements such as an oil pot or greaser (not shown) that is used to provide lubrication to the moving parts of the traverse. By locating the traverse 816 lateral of the mandrel 170, any excess lubrication that is applied to the traverse will not drip on the coil being formed on the mandrel 170.

In one embodiment, platform 950 is arranged to move laterally away from the mandrel 170 as wire is wound as a coil on the mandrel 170. In another embodiment, platform 950 is arranged to move away from the mandrel 170 along two axes as wire is wound as a coil on the mandrel 170. In one embodiment, roller 941*b* of wire guide 910 approximates the mandrel 170 and the coil that is formed on the mandrel as wire is wound into a coil on the mandrel. In one embodiment, wire is applied from the traverse 816 to the mandrel such that the wire is substantially tangent the mandrel as it is applied.

In one embodiment the end-forms 177 of the mandrel 170 are in the shape of disks with flat inner faces facing each other. In another embodiment the end-forms 177 of the mandrel 170 are shaped as cymbals with the inner surfaces diverging from each other as they extend away from the mandrel 170. The end-forms 177 may be caused to assume other shapes as desired.

In one embodiment, the mandrel 170 is barrel-shaped. In another embodiment, the mandrel is cylindrical. In other embodiments, the mandrel 170 may take other forms.

Figure 10A:
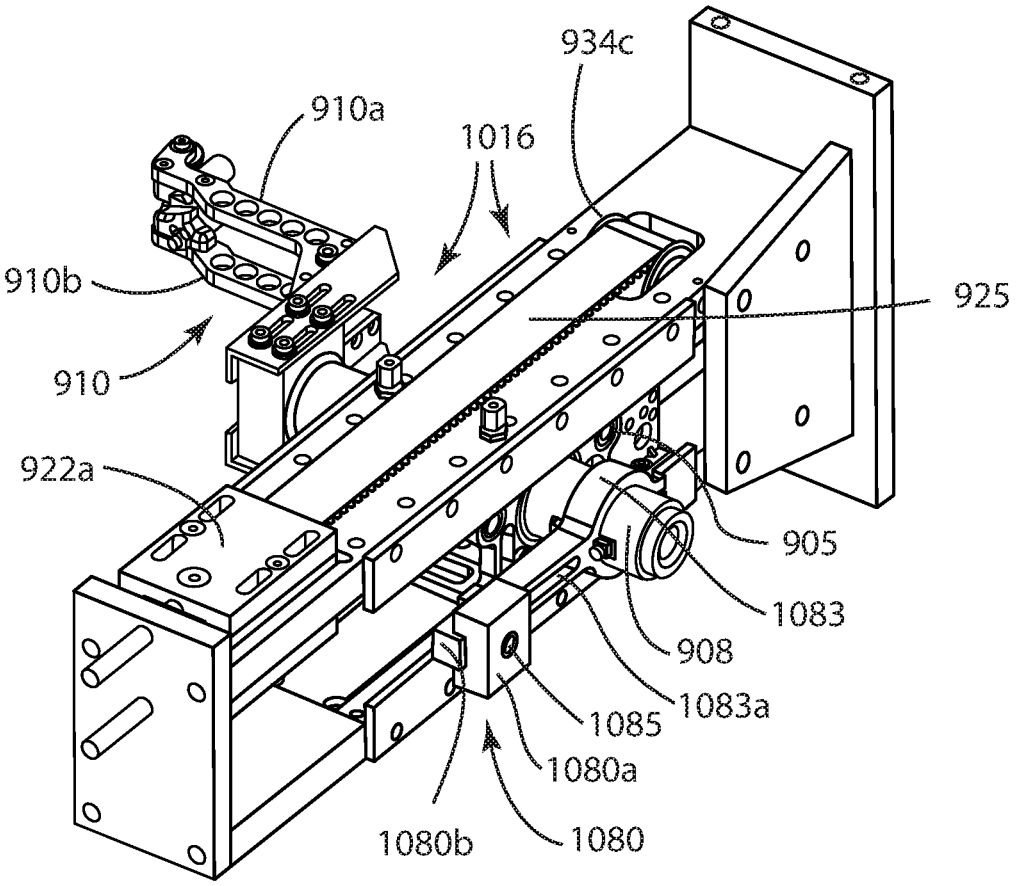
FIGS. 10*a*-10*c* are respectively a back perspective view and back views of another embodiment of a traverse.
Figure 10B:
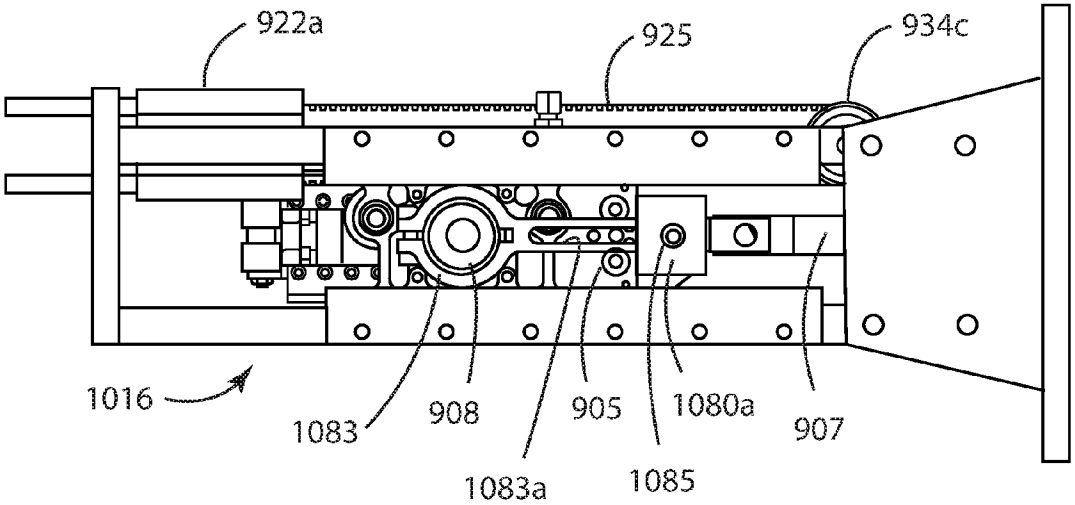
Figure 10C:
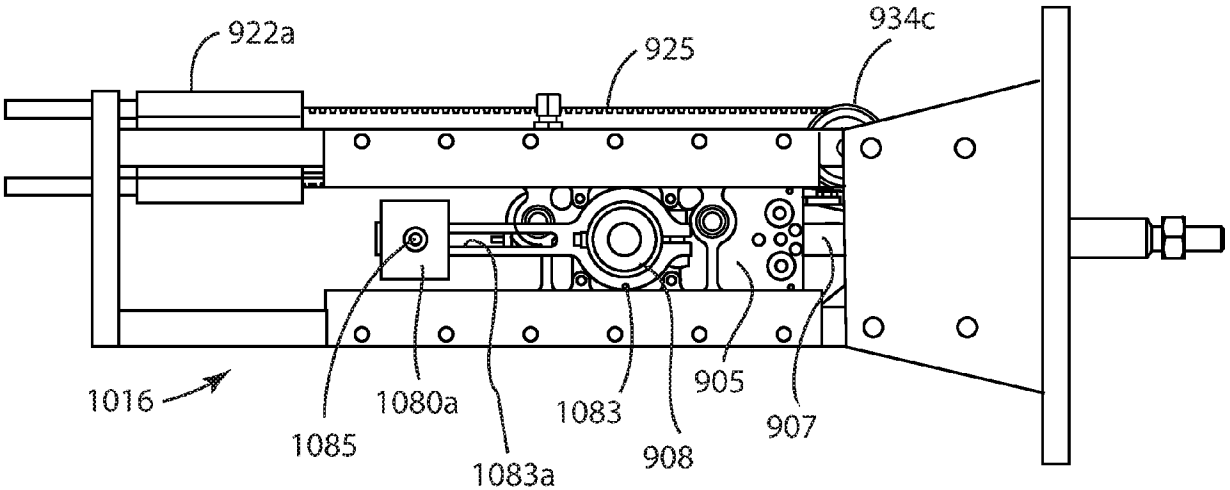

Turning to FIGS. 10*a*-10*c*, a traverse 1016 is provided which is nearly identical to the traverse 816 of FIG. 9, and the elements of traverse 1016 that are identical to that of traverse 816 are shown with the same numbering as traverse 816. Thus, traverse 1016 is shown with a carriage 905, cam arm 907, rotating tube 908, wire guide 910 with arms 910*a*, 910*b*, belt 925, belt tensioner 922*a*, roller 934*c*, etc. which are oriented at a rotation of ninety degrees relative to the embodiments of FIGS. 2, 3, 4*a*-4*c*, and 8*a*-8*b*. The traverse 1016 functions substantially as traverse 116 of FIGS. 2 and 3, traverse 416 of FIGS. 8*a* and 8*b*, and traverse 816 of FIG. 9 with the wire guide 910 rotating with tube 908 and reciprocating relative to the mandrel as the carriage reciprocates in the cantilever beam 816*a*. However, the embodiment of FIGS. 10*a*-10*c* also shows a counterbalance (weight) 1080 which is not provided in the embodiment of FIG. 9. The counterbalance 1080 is attached via a clamp 1083 to the rotating tube 908 on the end 908*a* of the tube 908 opposite the wire guide 910. In one embodiment, counterbalance 1080 is an adjustable counterbalance that includes first and second sections 1080*a*, 1080*b* which are attached to each other, e.g., via a screw 1085, and with at least one of the sections extending through a slot 1083*a* defined in clamp 1083. When counterbalance sections 1080*a*, 1080*b* are screwed to each other tightly, they are fixed on the clamp 1083. The counterbalance may be adjusted by loosening the screw, moving the counterbalance along the slot 1083*a* to a desired location, and then tightening the screw.

As seen in FIGS. 10*b* and 10*c*, the counterbalance 1080 and clamp 1083 travel and rotate with the rotating tube 908. Thus, in FIG. 10*b*, the counterbalance 1080 is shown at a "three o'clock" position with the carriage 905 at one end of its reciprocating movement, and in FIG. 10*c*, the counterbalance 1080 is shown at a "nine o'clock" position with the carriage 905 at the other end of its reciprocating movement. In this manner, and according to one aspect, the counterbalance 1080 can act to reduce vibrations in the system which result from the rotation of the wire guide 910.

In one embodiment, a method for winding a coil of wire in a figure-eight pattern includes rotating a mandrel about which the wire is to be wound, and feeding the wire onto the mandrel via a reciprocating, rotating element of a traverse that reciprocates back and forth relative to the rotating mandrel in a direction parallel to an axis of rotation of the mandrel and simultaneously rotates back and forth about an axis perpendicular to the axis of reciprocation. In one embodiment, the reciprocating, rotating element is a wire guide and the method includes rotating the wire guide one hundred eighty degrees as it moves from one end of its throw to the other end of its throw. In one embodiment, the method wire guide has a bottom edge from which the wire is dispensed (e.g., a wire output location), and the method includes locating the bottom edge substantially adjacent the mandrel at the start of a winding process and moving the bottom edge radially in at least one direction away from the mandrel as the wire is wound on the mandrel such that the bottom edge remains substantially adjacent the wire coil being wound on the mandrel.

In one embodiment, a method involves providing a sensor to inform movement of the traverse away from the mandrel. In another embodiment, a method involves controlling movement of the traverse away from the mandrel based on the diameter of the wire and the number of reciprocations of the traverse.

It will be appreciated that the system 100 has been described as including a controller 118. The controller 118 is shown as a separate unit, but it should be appreciated that the controller may also reside with the take-up unit 116, the dancer 114, or the payoff unit 112, or may be distributed amongst them. The controller 118 may have a touch-screen or other interface that permits a user to select a tension control profile for the coil, and to select other parameters that may impact the forming of the wire coil and includes a processor or processing system. The terms "processor" and "processing system" (hereinafter "processing system") should not be construed to limit the embodiments disclosed herein to any particular device type or system. The processing system may be a laptop computer, a desktop computer, or a mainframe computer. The processing system may also include a processor (e.g., a microprocessor, microcontroller, digital signal processor, programmable logic controller, or general purpose computer) for executing any of the methods and described above. The processing system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device. This memory may be used to store, by way of example only, parameters for movement of the platform supporting the cantilever beam based on the wire thickness, parameters for controlling overall line speed, parameters for generating a payout hole size and shape in the wound coil as it is wound, and instructions for performing the methods described above.

Any of the methods described above can be implemented as computer program logic for use with the processing system. The computer program logic may be embodied in various forms, including a source code form or a computer executable form. Source code may include a series of computer program instructions in a variety of programming languages (e.g., an object code, an assembly language, or a high-level language such as FORTRAN, C, C++, or JAVA). Such computer instructions can be stored in a non-transitory computer readable medium (e.g. memory), and executed by the processing system. The computer instructions may be distributed in any form as a removable storage medium with accompanying printed or electronic documentation (e.g. shrink wrapped software), preloaded with a computer system (e.g. on system ROM or fixed disk), or distributed via Internet Protocol (IP).

There have been described and illustrated herein several embodiments of an apparatus and method for winding a coil. While particular embodiments have been described, it is not intended that the invention be limited thereto, as it is intended that the invention be as broad in scope as the art will allow and that the specification be read likewise. Thus, while a particular embodiment of a carriage that is used to translate and rotate a wire guide has been described, it will be appreciated that the carriage may take other forms. Similarly, while particular embodiments of wire guides for laying the wire down substantially adjacent the mandrel have been described, it will be appreciated that the wire guide may take other forms. Further, while particular embodiments of platform movement elements have been described for moving the traverse away from the mandrel, it will be appreciated that other mechanisms may be utilized to controllably move the traverse away from the mandrel as the coil is being formed. It will therefore be appreciated by those skilled in the art that yet other modifications could be made to the provided invention without deviating from its spirit and scope as claimed. In the claims, means-plus-function clauses, if any, are intended to cover the structures described herein as performing the recited function and not only structural equivalents, but also equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A system for winding wire, comprising:

a) a mandrel around which the wire is to be wound, said mandrel rotating about a longitudinal axis;

b) a traverse arranged to cause the wire to be wound in a figure-eight configuration on said rotating mandrel to form a coil having many layers of the wire, said traverse comprising a wire directing device including a reciprocating, rotating element that reciprocates back and forth along a first axis parallel to said longitudinal axis and rotates along a second axis perpendicular to said longitudinal axis as it reciprocates.

2. A system according to claim 1, wherein:

said reciprocating, rotating element rotates one hundred eighty degrees for every full throw in one direction.

3. A system according to claim 1, wherein:

said traverse comprises a beam and a carriage that reciprocates at least partially inside said beam, said carriage including a gear that rotates as said carriage reciprocates.

4. A system according to claim 3, wherein:

said carriage further includes two in-line wheels, said gear being between said two in-line wheels and offset therefrom, said traverse including a grooved belt located between said in-line wheels and said gear and coupled to said beam such that as said carriage reciprocates inside said beam, said gear engages said grooved belt and rotates.

5. A system according to claim 4, wherein:

said traverse further comprises a cam arm coupled to said carriage, said cam arm causing said carriage to reciprocate.

6. A system according to claim 1, wherein:

said wire directing device includes a wire guide having a terminal at which the wire is dispensed, said terminal rotating one hundred eighty degrees for each throw of said reciprocating, rotating element.

7. A system according to claim 6, further comprising:

first and second end-forms coupled to the mandrel, wherein on each throw of said reciprocating, rotating element, said terminal is directly adjacent one of said first and second end-forms.

8. A system according to claim 7, wherein:

said terminal reciprocates and rotates inside an imaginary cylinder defined by said end-forms a vast majority of time the wire is being wound into a coil.

9. A system according to claim 7, wherein:

at a start position, said terminal is directly adjacent said mandrel.

10. A system according to claim 9, further comprising:

movement apparatus coupled to said traverse arranged to move said traverse from said start position where said terminal of said wire directing device is directly adjacent said mandrel to positions radially away from said start position as the wire is wound about said mandrel such that said terminal stays directly adjacent a surface of the wire wound around said mandrel.

11. A system according to claim 10, further comprising:

a controller that controls said movement apparatus.

12. A system according to claim 10, wherein:

said movement apparatus includes a motor.

13. A system according to claim 9, wherein:

said terminal directs the wire substantially tangent to a surface of said mandrel.

14. A system for winding wire, comprising:

a wire take-up unit including a rotating mandrel having an axis of mandrel rotation, end-forms coupled to said mandrel, and a traverse arranged to cause said wire to be wound in a figure-eight configuration on said rotating mandrel and between said end-forms to form a coil having many layers of wire, said traverse comprising a wire directing device including a reciprocating, rotating element that reciprocates back and forth along a first axis parallel to said axis of mandrel rotation and rotates along a second axis perpendicular to said first axis as it reciprocates, and a movement apparatus that moves said reciprocating, rotating element radially relative to said mandrel, said wire directing device defining a terminal from which the wire is dispensed, said terminal reciprocating, rotating, and moving radially relative to said mandrel and located inside an imaginary cylinder defined by said end-forms a vast majority of time the wire is being wound into said coil.

15. A system according to claim 14, wherein:

at a start position, said terminal is directly adjacent said mandrel, and said terminal remains directly adjacent an outer surface of the wire coil as the wire coil is being wound.

16. A system according to claim 15, wherein:

said traverse comprises a beam, a cam arm, a carriage coupled to the cam arm that reciprocates at least partially inside said beam, said carriage including a gear that rotates as said carriage reciprocates.

17. A system according to claim 16, wherein:

said wire directing device includes a wire guide coupled to said carriage and extending from a first side of said beam and a counterweight coupled to said carriage and extending from a second side of said beam.

18. A method of winding wire, comprising:

obtaining a wire winding device having a rotating mandrel around which the wire is to be wound and a traverse comprising a wire directing device including a reciprocating, rotating element that reciprocates back and forth along a first axis parallel to the axis of rotation of the mandrel and rotates along a second axis perpendicular to said first axis as it reciprocates;

winding the wire over the mandrel in a figure-eight pattern to form a coil with many wire layers, said winding including causing said reciprocating, rotating element to reciprocate and rotate.

19. A method according to claim 18, further comprising:

moving the traverse away from the mandrel as the wire layers of the coil are laid down on the mandrel.

20. A method according to claim 18, wherein:

said wire winding device has end-forms, said wire directing device has a terminal, and said winding comprises locating the bottom edge directly adjacent the mandrel at a start position, moving the traverse away from the mandrel so that the terminal is located directly adjacent the surface of the wire layers of the coil as the coil is formed, and rotating said reciprocating, rotating element so that the terminal is located directly adjacent the end-forms for each throw of said wire directing device.

* * * * *